US006789684B1

(12) United States Patent
Drower et al.

(10) Patent No.: US 6,789,684 B1
(45) Date of Patent: Sep. 14, 2004

(54) STORAGE CONTAINER FOR CARDS AND FILE FOLDERS

(75) Inventors: Herbert M. Drower, Wilmette, IL (US); James T. Carlin, Rocky River, OH (US)

(73) Assignee: Transilwrap Company, Inc., Franklin Park, IL (US)

( * ) Notice: Subject to any disclaimer, the term of this patent is extended or adjusted under 35 U.S.C. 154(b) by 4 days.

(21) Appl. No.: 10/242,650

(22) Filed: Sep. 12, 2002

(51) Int. Cl.[7] ..... B42F 17/00

(52) U.S. Cl. ..... 211/11; 211/45; 211/51; 211/184

(58) Field of Search ..... 211/45, 50, 11, 211/46, 51, 120, 59.2, 184; 40/371; 312/183, 184, 34.1

(56) References Cited

U.S. PATENT DOCUMENTS

| | | | | |
|---|---|---|---|---|
| 231,969 A | | 9/1880 | Perkins | |
| 586,238 A | | 7/1897 | King | |
| 1,026,241 A | | 5/1912 | Buckingham | |
| 1,214,606 A | | 2/1917 | Steig | |
| 1,388,154 A | | 8/1921 | Coutts | |
| 1,429,846 A | | 9/1922 | Coutts | |
| 1,508,680 A | | 9/1924 | Daniels | |
| 1,664,650 A | * | 4/1928 | Van Korlaar | 211/11 |
| 1,746,577 A | | 2/1930 | Berglund et al. | |
| 1,783,840 A | * | 12/1930 | Goeller | 211/85.3 |
| 1,822,734 A | | 9/1931 | Harrington | |
| 2,109,713 A | * | 3/1938 | Schroeder | 211/11 |
| 2,397,291 A | | 3/1946 | Robertson | |
| 2,430,624 A | | 11/1947 | Vollmer | |
| 2,591,805 A | | 4/1952 | Gossett | |
| 2,615,577 A | | 10/1952 | Bartleman | |
| 2,639,526 A | * | 5/1953 | Bepristis | 40/536 |
| D175,455 S | | 8/1955 | Bartleman | |
| 2,769,550 A | * | 11/1956 | Rollins et al. | 211/11 |
| 2,964,195 A | * | 12/1960 | Valis | 211/11 |
| 2,975,949 A | | 3/1961 | Lutsky | |
| 3,094,129 A | | 6/1963 | Wills | |
| 3,165,283 A | | 1/1965 | Borisof | |
| 3,305,100 A | | 2/1967 | Barbee | |
| 3,309,052 A | | 3/1967 | Borisof | |
| 3,363,340 A | | 1/1968 | McKinley | |
| 3,388,809 A | | 6/1968 | Irish | |
| 3,405,809 A | | 10/1968 | Schatz | |
| 3,812,976 A | | 5/1974 | Rempel | |
| 3,838,679 A | * | 10/1974 | Welch | 126/541 |
| 3,908,215 A | * | 9/1975 | Watson | 412/9 |
| 4,176,752 A | | 12/1979 | Taber | |
| 4,198,105 A | * | 4/1980 | Gibbs | 312/183 |

(List continued on next page.)

FOREIGN PATENT DOCUMENTS

| | | |
|---|---|---|
| GB | 8483 | 4/1904 |

* cited by examiner

*Primary Examiner*—Jennifer E. Novosad
(74) *Attorney, Agent, or Firm*—Cook, Alex, McFarron, Manzo, Cummings & Mehler, Ltd.

(57) ABSTRACT

A storage container for cards and file folders. The container has an open top tray with a bottom, side and end walls. A rod extending through the tray between the end walls. A multiplicity of retainer loops mounted on the rod inside the tray. Each retainer loop formed of a tough, resilient, abrasive-resistant resin having a bight portion and two legs. The retainer loops positioned in the tray with their bight portions extending above the side walls of the tray. An opening formed in each leg of each retainer loop to receive the rod to retain the loops in the tray. A slit extends from the opening in each leg to the outer edge thereof to permit the legs to be easily mounted on and removed from the rod. The side walls of the tray are inclined upwardly from front to rear and the retainer loops are varied in height from front to rear to provide a stepped positioning of the cards or file folders held between the retainer loop. The storage container may be formed as a portion of a note paper holder.

4 Claims, 3 Drawing Sheets

U.S. PATENT DOCUMENTS 4,369,887 A * 1/1983 Emery ..... 211/59.3
4,545,489 A * 10/1985 Welch ..... 211/11
4,588,093 A * 5/1986 Field ..... 211/51
4,600,110 A * 7/1986 Timor ..... 211/120
4,757,906 A 7/1988 Ovitz, III
4,936,469 A 6/1990 Drower
4,974,733 A * 12/1990 Evans ..... 211/11
5,123,546 A * 6/1992 Crum ..... 211/59.3
5,398,823 A 3/1995 Anders
5,419,443 A 5/1995 Niederberger et al.
5,570,794 A 11/1996 Drower
5,718,342 A 2/1998 Drower et al.
5,775,520 A 7/1998 Drower
5,779,066 A 7/1998 Drower et al.
5,816,418 A * 10/1998 Hsu ..... 211/120
5,915,573 A 6/1999 Drower et al.
5,988,407 A * 11/1999 Battaglia ..... 211/51
6,012,594 A * 1/2000 Heinz ..... 211/46
6,015,051 A * 1/2000 Battaglia ..... 211/59.3

STORAGE CONTAINER FOR CARDS AND FILE FOLDERS

BACKGROUND AND SUMMARY OF THE INVENTION

Storage racks for small articles, ranging from pencils and pens to other items such as paint brushes, cassettes and small containers are shown in U.S. Pat. Nos. 4,936,469; 5,570,794 and 5,718,342. The racks of these patents are not specifically intended to support thin, planar objects such as business calling cards, index cards and file folders of the type which are usually stored in an upstanding orientation in offices but instead were designed to support such articles in a hanging or vertical orientation although such racks could be used for storage of business calling cards, index cards and file folders under some circumstances.

SUMMARY OF THE INVENTION

It is a principal object of the present invention to provide a storage rack or container for thin, planar objects such as business calling cards, index cards and even file folders that can handily be located on a desk, credenza, file cabinet or table where the storage rack supports the planar objects in an upstanding orientation.

Another object of this invention is a storage rack or container for thin, planar objects such as cards and file folders which securely supports the objects regardless of their size or thickness.

An additional object of this invention is a storage rack or container for cards or file folders that displays the cards or file folders in a stepped relation to one another from the front to rear of the rack or container for easy viewing and retrieval of the cards or file folders.

Yet another object of this invention is a storage rack or container for cards or file folders which facilitates the insertion and removal of cards and folders from the supports.

Other objects of the invention will be found in the following specification, claims and drawings.

DESCRIPTION OF THE PREFERRED EMBODIMENTS

Figure 1:
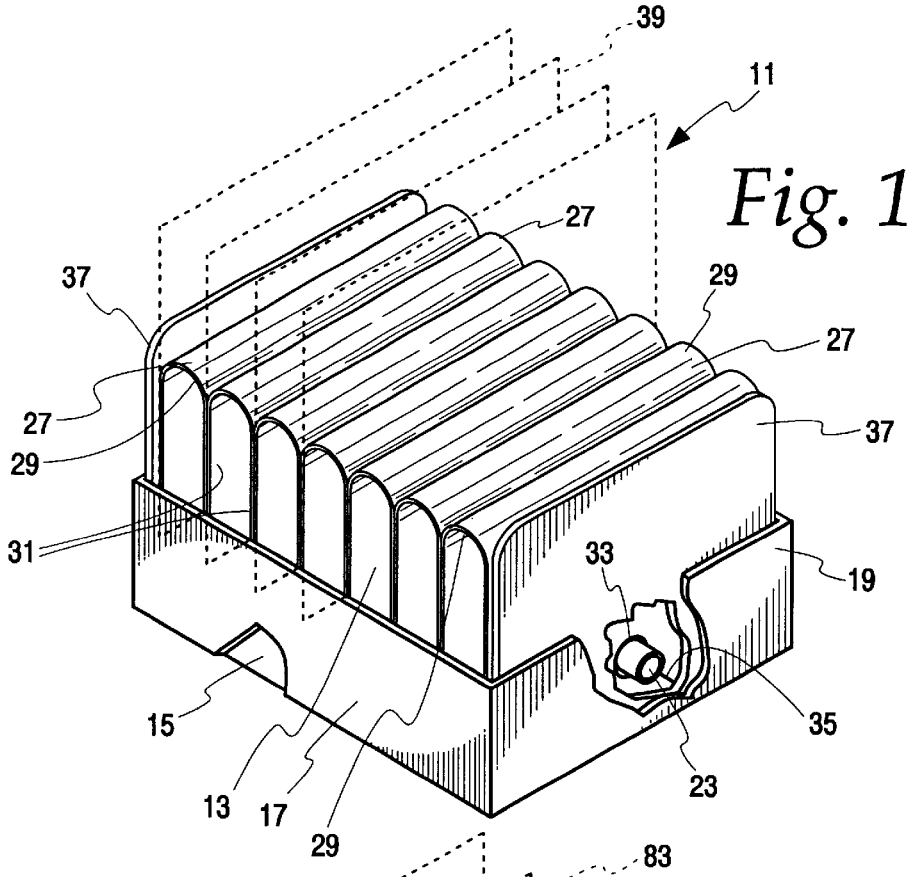
FIG. 1 is an orthographic view of a first embodiment of a storage rack or container of this invention with some parts broken away and others shown in phantom lines for clarity of illustration.

A first embodiment of the container or storage rack 11 of this invention is shown in FIG. 1 of the drawings. The container includes an open top 13, a bottom wall 15, a pair of opposite side walls 17 and a pair of opposite end walls 19. The bottom wall 15 may be omitted from certain constructions and the container 11 would then be more correctly called a rack but these terms will be used interchangeably throughout these descriptions of the inventions. The storage rack may be formed of any suitable material such as wood, plastic or pressed fiberboard although plastic is preferred because of its light weight, low cost and ease of forming.

A rod 23, preferably metal, of generally circular cross-section extends between the opposite end walls 19 of the rack 11 which may also be referred to as the front and rear walls for purposes of orientation. The storage rack has installed a multiplicity of retainer loops 27. Each retainer loop 27 is formed of a strip of a tough, resilient, abrasive-resistant resin, preferably a polyester resin or a laminate. The preferred construction for each retainer loop is two layers of oriented polyethylene terephthalate laminated with a central layer of polyethylene, the same basic construction as is used in commercial identification cards and similar articles. Each retainer loop 27 is formed with a bight portion 29 joining a pair of legs 31 which is this embodiment of the invention are of equal length. An opening or passage 33 is formed in each of the legs 31 to receive the rod 23. The openings 33 need not be circular nor need they have a closed boundary so long as the opening can receive the rod 23. In some circumstances, it may be preferred that the passage have a closed boundary so that the retainer loops can not be easily pulled off the rod, but in other circumstances the passage may be open to the exterior of the leg by means of a suitable slit 35 to allow the legs of the retainer loop to be pulled over and removed from the rod 23. As shown in FIG. 1, the slit 35 may extend at an angle to the length of its leg 31 to resist pull off from the rod 23.

End bulkheads 37 to support the retainer loops 27 are positioned against the end walls 17 of the container 11 and extend substantially the same height as the retaining loops 27. End bulkheads 37 each also have a passage extending therethrough to receive and be held by the rod 23.

The rectangular objects 39, shown in phantom lines in FIG. 1, are representative of the business calling cards, index cards or file folders which may be held between the retainer loops 27 in positions inwardly of the side walls 17 of the container or storage rack 11 in the manner shown. A container or storage rack of this invention may be sized to receive business calling cards, index cards or file folders with the dimensions of the end and side walls being changed to accommodate the particular item desired to be stored. Further, the size of the retainer loops 27 both in width and height can be varied for storage of each type of card or file folder. It is contemplated in this embodiment of the invention that the card, index card or file folder 39 will extend vertically above the bight portions 29 of the retainer loops 27 so that the item is visible and readily accessible to a user.

Figure 2:
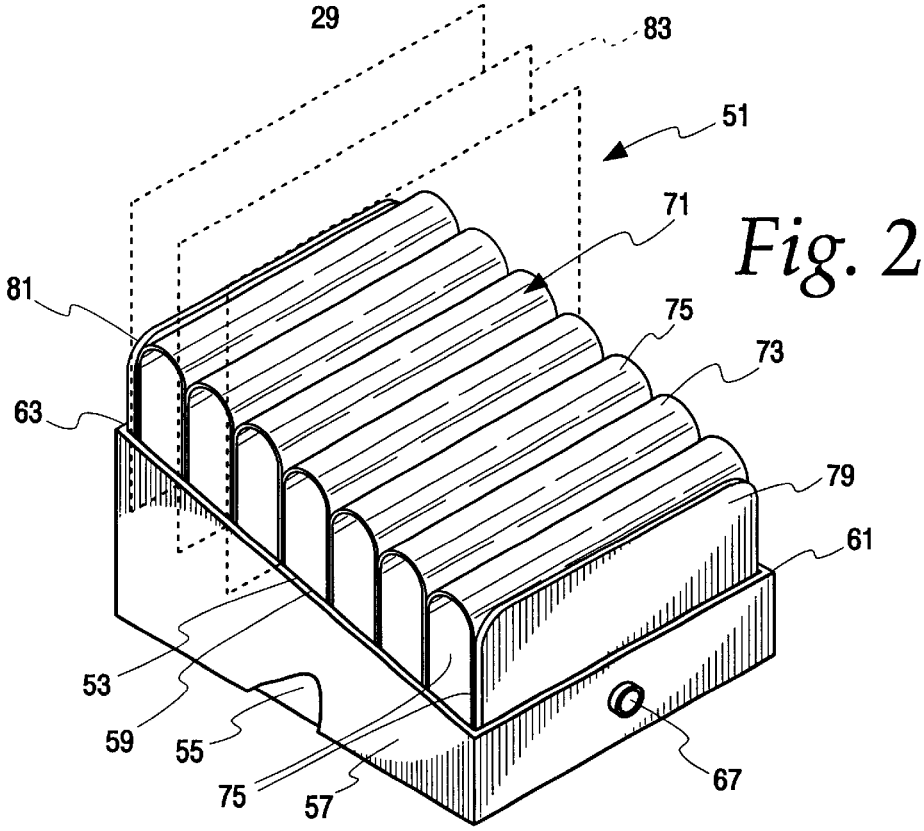
FIG. 2 is an orthographic view of a second embodiment of a storage rack or container of this invention with adjacent retainer loops stepped upwardly from the front to the rear of the rack or container.

FIG. 2 of the drawings shows a modified container or storage rack 51 also having an open top 53, bottom wall 55, side walls 57 each with an inclined top edge 59, a shorter end wall 61 and a taller end wall 63. The container or storage rack 51, which can be converted from a container to a storage rack by the inclusion or omission of a bottom wall 55, includes a rod 67 that extends between the shorter end wall 61 and the taller end wall 65. For convenience of description, the end wall 61 can be considered the front wall of the container and the end wall 63 can be considered the rear wall.

Retainer loops 71 are positioned inside the container or storage rack and they are similar in construction to the retainer loops 27 of the first embodiment of the invention each having bight portions 73. However, while the two legs 75 of each retainer loop 71 are of identical length or height the legs of adjacent retainer loops vary in height. The retainer loops are positioned within the rack so that the loop with the shortest legs is located adjacent the bulkhead 79 positioned adjacent the front end wall 61 and the retainer loop with the tallest legs is positioned adjacent the taller bulkhead 81 located adjacent the rear end wall 63 of the rack.

The rod 67 extends through the end wall 61, bulkhead 79, retainer loop legs 75, bulkhead 81 and end wall 63 to hold the retainer loops inside the end and side walls of the container or rack 51 while locating the bight portions of each retainer loop leg in incrementally stepped arrangement extending from the shorter front end wall 61 to the taller rear end wall 63 of the rack. The flat, planar, generally rectangular items indicated by the phantom lines 83 may be business cards, index cards or file folders with the dimensions of the storage rack and retainer loops adjusted to specifically hold any one of these types of items. Passages may be formed in the legs 75 of the retainer loops 71 and these passages need not be circular or have closed boundaries as long as they enable the retainer loops 71 to fit over and be held by the rod 67.

Figure 3:
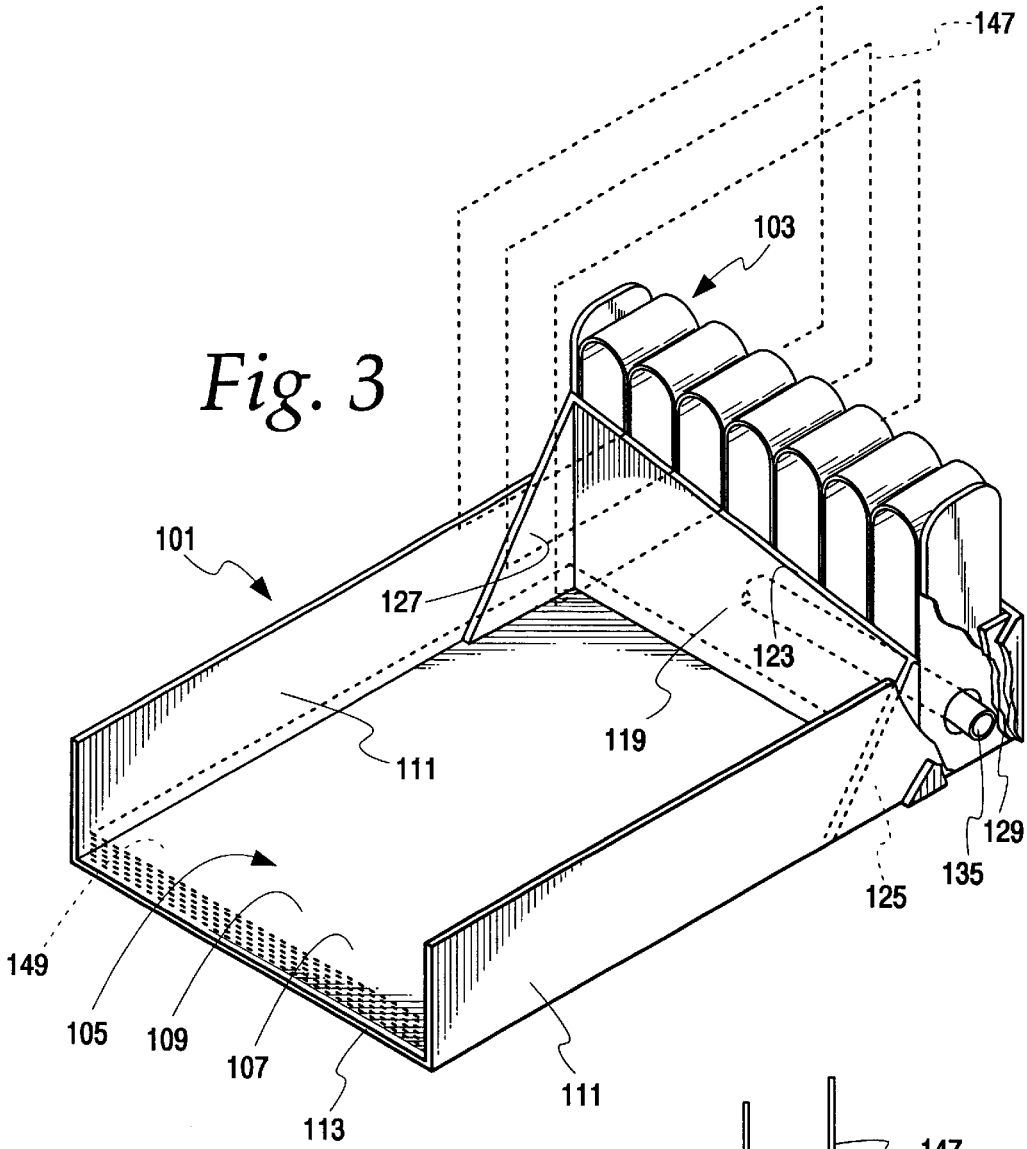
FIG. 3 is an orthographic view of a combined storage rack and note paper holder of a third embodiment of this invention with some portions broken away and others shown in phantom lines for clarity of illustration.
Figure 4:
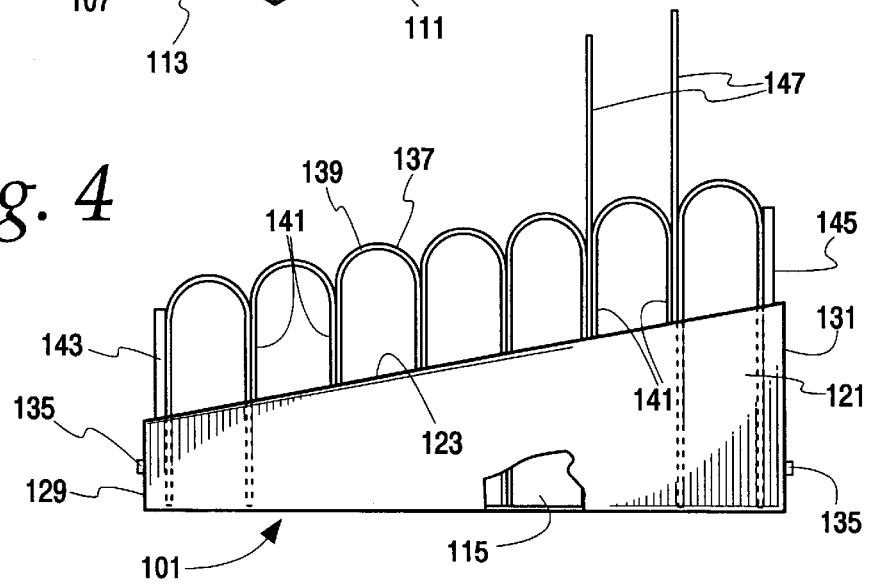
FIG. 4 is an end elevational view of the combined storage rack and note paper holder of FIG. 3.

A third embodiment of the invention is shown in FIGS. 3 and 4 of the drawings. The third embodiment is a combined storage rack and note paper holder 101 having a card storage container 103 located at one end and a note paper holder 105 located at the opposite end. This combined storage rack and note paper holder includes a tray portion 107 formed of a bottom wall 109 with upstanding side walls 111, an open end 113 and an open end 115. The card storage container 103 utilizes the side walls 111 of the tray portion 107 as its end walls and has an internal side wall 119 extending between the side walls 111 and an external side wall 121 extending beyond the side walls 111 of the note paper holder. The internal and external side walls 119 and 121 each have an identically inclined top edge 123. The internal side wall 119 includes triangular end support walls 125 with the triangular end wall 125 at its lower end being shorter than the triangular end wall 127 at its upper end with the end support walls 125 and 127 resting on the bottom wall 109 of the tray portion 107. The external side wall 121 has an integral triangular end wall 129 at its lower end and an integral triangular end wall 131 at its upper end with these walls located outside of the side walls 111 of the tray.

A rod 135 extends through the tray portion 107 of the combined rack and holder 101 from one end wall to the other end wall thereof. Retainer loops 137 similar in construction to the retainer loops 27 previously described are positioned in the storage container 103. Each retainer loop has a bight portion 139 and legs 141 extending from the bight portion. The lengths of the legs of the multiplicity of retainer loops vary incrementally so that the bight portions of the loops may be stepped upwardly from the shorter end wall of the tray 107 to the taller end wall as shown in FIGS. 3 and 4 of the drawings. Accordingly, a shorter end bulkhead 143 is located at the short end of the tray and a taller end bulkhead 145 is located at the taller end of the tray 107. Flat, planar, generally rectangular objects 147, shown in phantom lines in FIG. 3 of the drawings, are representative of the business calling cards, index cards and file folders which may be stored between and held by the retainer loops 137. Sheets 149 of note paper may be stored in the note paper holder 105.

Figure 5:
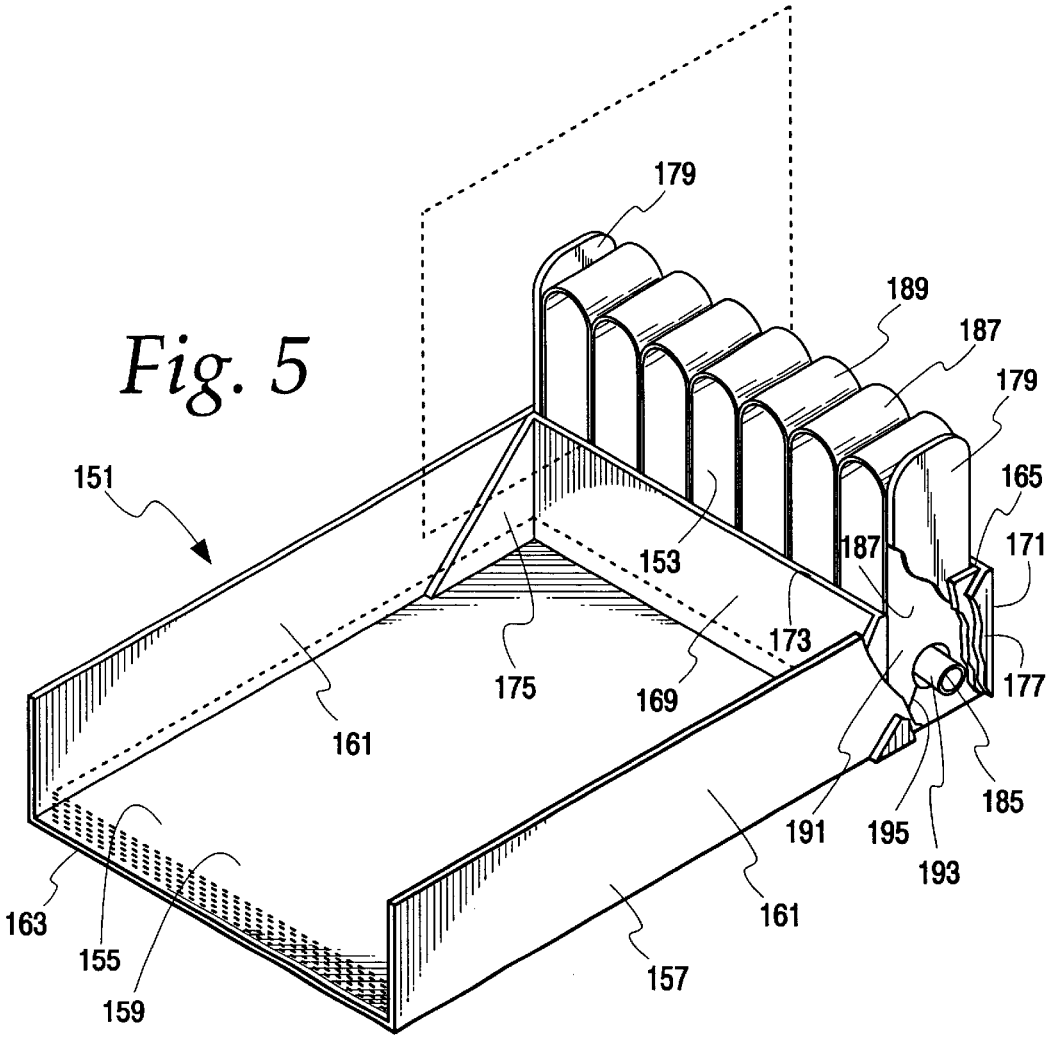
FIG. 5 is an orthographic view of a combined storage rack and note paper holder of a fourth embodiment of this invention with some portions broken away and others shown in phantom lines for clarity of illustration.
Figure 6:
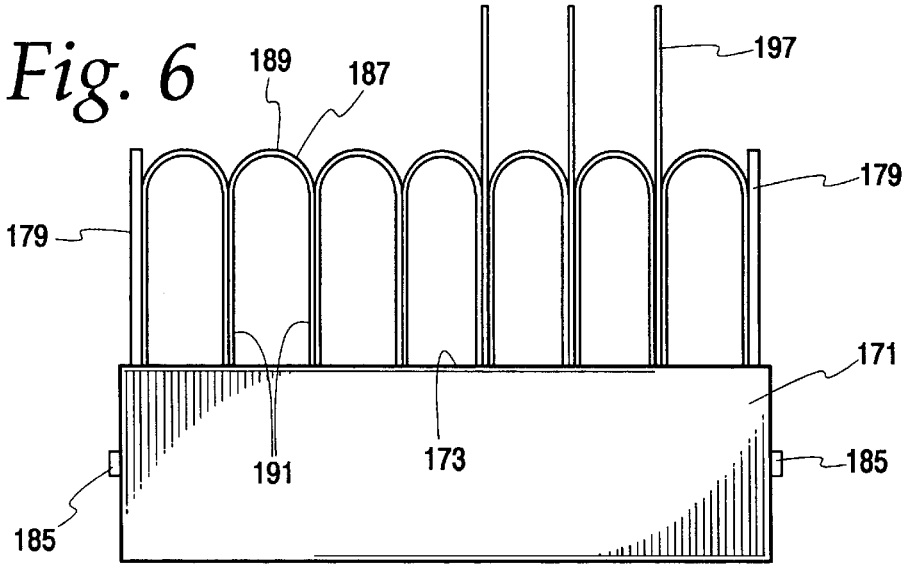
FIG. 6 is an end elevational view of the combined storage rack and note paper container of FIG. 5.

A fourth embodiment of the invention is shown in FIGS. 5 and 6 of the drawings. It is similar in construction to combined storage rack and note paper holder 101 shown in FIGS. 3 and 4 of the drawings.

Combined storage rack and note paper holder 151 has a card storage container 153 at one end and a note paper holder 155 at the opposite end. The note paper holder 155 is formed as a part of a tray portion 157 having a bottom wall 159, side walls 161 and open ends 163 and 165. The card storage container 153 utilized the side walls 161 of the tray portion 157 as its end walls and has an internal side wall 169 extending between the walls 161 and an external side wall 171 extending beyond the side walls 161. The side walls 169 and 171 have flat top edges 173 extending between the side walls 161 of the tray portion 157. Triangular end walls 175 are formed integrally with the internal side wall 169 while triangular end walls 177 are formed integrally with the external side wall 171 and are located outwardly of the side walls 161 of the tray portion 157. End bulkheads 179 are located at the ends of the storage container 153.

A rod 185 extends through the side walls 161, bulkheads 179 and the retainer loops 187 which are positioned in the storage rack between the end bulkheads 179. The retainer loops 187 are formed of the same material and in the same manner as described for the retainer loops 27 previously described in connection with the embodiment of FIG. 1 of this specification. Each retainer loop has a bight portion 189 connecting legs 191, which in this embodiment of the invention are the same length. A passage 193 is formed in each leg to receive the rod 185. The passage need not be circular or have a closed boundary but may be formed with a slit 195 to allow the leg to be attached to or removed from the rod 185 without disassembling the entire storage rack. The slit 195 need not extend from the passage 193 longitudinally of the leg 191 but may extend at an angle as seen in FIG. 5.

What is claimed is:

1. A storage container for cards and file folders, comprising:

an open top tray having a bottom wall and side and end walls, a rod extending through the tray between said end walls, a plurality of retainer loops mounted side by side on said rod inside said tray, each retainer loop formed of a strip of a tough, resilient, abrasive-resistant resin having a bight portion and two legs, said retainer loops positioned in said tray with said bight portions extending above said side walls of said tray, an opening formed in each leg of said retainer loops near the distal end of each leg for receiving said rod to retain said retainer loops in said tray, said legs of said retainer loops having varying lengths with said retainer loops having the longest legs located at one of said end walls and said retainer loops having the shortest legs located at the other of said end walls, said legs of said retainer loops tapering generally uniformly from said longest legs to said shortest legs.

2. The storage container of claim 1 in which end bulk heads are installed in said tray and extend above said side walls to approximately the height of said bight portions of said retainer loops.

3. The storage container of claim 1 in which a slit extends from said opening in each leg to an edge of each leg to permit said leg to be attached to and removed from said rod.

4. The storage container of claim 1 in which said side walls of said tray taper in height from a taller end adjacent one end wall of said container to a shorter end adjacent said other end wall of said container.

* * * * *